United States Patent [19]

Richardson et al.

[11] 4,129,298

[45] Dec. 12, 1978

[54] GAME APPARATUS

[76] Inventors: Dwight Richardson; Jerome Richardson, both of 2011 Old Elm Rd., Lindenhurst, Ill. 60046

[21] Appl. No.: 769,445

[22] Filed: Feb. 17, 1977

[51] Int. Cl.[2] ..... A63B 67/06

[52] U.S. Cl. ..... 273/100; 273/104

[58] Field of Search ..... 273/95 R, 100, 106 B, 273/126 R, 126 A, 104

[56] References Cited

U.S. PATENT DOCUMENTS

| | | | |
|---|---|---|---|
| Re. 28,467 | 7/1975 | Curtiss et al. | 273/100 |
| 163,845 | 6/1875 | Browne | 273/100 |
| 489,856 | 1/1893 | Davids | 273/126 R |
| 605,723 | 6/1898 | Klauder | 273/100 |
| 1,191,330 | 7/1916 | Marley | 273/126 R |
| 1,525,962 | 2/1925 | Shasteen | 273/126 R |
| 1,544,511 | 6/1925 | Whitney | 273/126 R |
| 1,551,981 | 9/1925 | Dette | 273/126 R |
| 1,552,057 | 9/1925 | Jay | 273/95 R |
| 1,558,088 | 10/1925 | Hanley | 273/126 R |
| 1,682,279 | 8/1928 | Hilpert | 273/126 R |
| 2,238,703 | 4/1941 | McIver et al. | 273/126 R |
| 2,662,518 | 12/1953 | Luthi | 273/126 R X |
| 2,666,642 | 1/1954 | Ward | 273/100 |

*Primary Examiner*—William H. Grieb
*Attorney, Agent, or Firm*—Robert D. Farkas

[57] ABSTRACT

A game apparatus comprises a game base having two elongated apertures therethrough at the bottom and three pegs projecting outwardly from the top. A game base is mountable on a given place disposing an open end of the apertures on the plane and two outer pegs perpendicular thereto with the third central peg at an acute angle with respect to the axes of the other two. At least one game ring is provided having an outer diameter and thickness configured to pass through either of the apertures and an inside diameter configured to encircle any of the pegs, whereby the ring can be either rolled through the apertures or thrown around the pegs.

7 Claims, 4 Drawing Figures

GAME APPARATUS

BACKGROUND OF THE INVENTION

The present invention relates to a game apparatus.

Game apparatuses are known in the prior art wherein discs or rings are rolled through apertures but these apparatuses have the disadvantage of not providing for both the rolling and the tossing of a ring at the same game base.

Among the known prior art game apparatuses that have this disadvantage are those taught in U.S. Pat. Nos. 1,191,330; 1,525,962; 1,544,511; 1,551,981; 1,558,088; 1,682,279; 2,238,703 and 2,662,518.

SUMMARY OF THE INVENTION

The principal object of the present invention is to provide a game apparatus not shown in the prior art.

This and other objects are achieved by the preferred embodiment of the invention in which a game base is provided comprising a vertical wall and a horizontal wall disposed across the top edge of the vertical wall and perpendicular thereto. Mounting members are provided at the bottom of the vertical wall to anchor the base to the floor or other plane.

The vertical wall has two vertically elongated slots cut through. These slots extend through to the bottom of the wall resulting in a pair of openings each defined by the cut edges of the vertical wall on the sides and top and the floor at the bottom. Furthermore, three pegs are fastened to the horizontal wall and extend upward and outward. The pegs are in a line parallel to the plane of the vertical wall with the two outermost pegs having equal length and disposed perpendicular to the horizontal wall and the center peg longer than the outer pegs and disposed at an acute angle with respect to the outer pegs. The center peg slopes forward at an angle preferably equal to 15°.

The game is played using one or more rings, each having an outer diameter and width configured to pass through either slot when rolling on its rim. The rings have an inner diameter larger than the peg diameter so that it may be thrown around any of the pegs.

The object of the game is for each player to either try to roll a ring through either slot or to encircle one of the pegs by tossing the rings. The players stand a distance from the game base when releasing the rings and try to amass points with a successful roll through the slots or "ringers" over the pegs. A specific point value is assigned to each successful try.

Having in mind the above and other objects that will be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawing.

BRIEF DESCRIPTION OF THE DRAWING

The invention will be described in detail, by way of example, with reference to the accompanying drawing, in which.

DETAILED DESCRIPTION OF THE INVENTION

Figure 1:
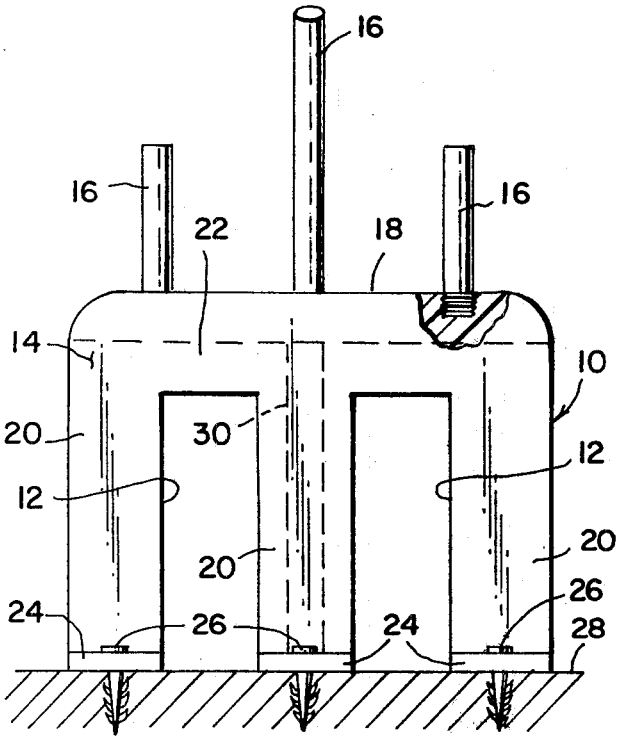
FIG. 1 is a front elevational view of the preferred embodiment.
Figure 2:
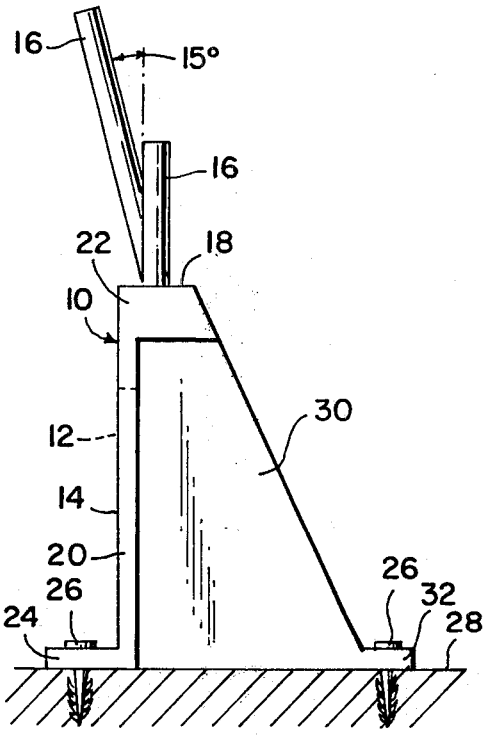
FIG. 2 is a side elevational view.

Referring to FIGS. 1–4 of the drawing and in accordance with the principles of the invention, a game apparatus is shown comprising a game base 10, having at least one vertical slot 12 having an open side cut through a first planar surface 14 or vertical face and at least one peg 16 upwardly disposed in a second planar surface 18 or top face affixed to the top edge of the vertical face and disposed perpendicularly thereto.

Figure 3:
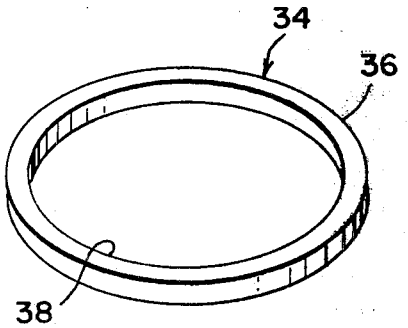
FIG. 3 is a perspective view of the ring.
Figure 4:
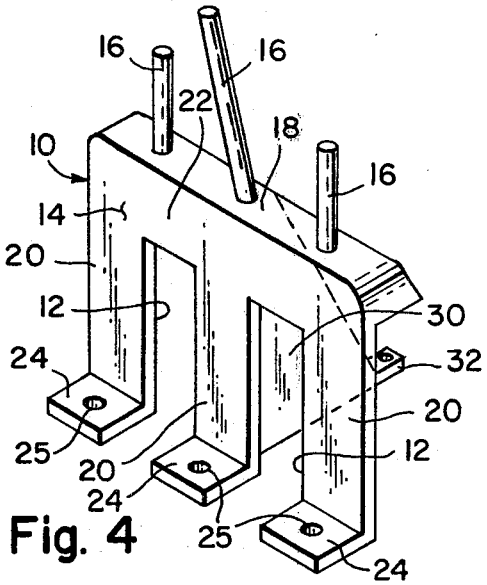
FIG. 4 is a perspective view of the game base.

In the preferred embodiment shown in FIGS. 1 and 3, the vertical face 14 has two parallel slots 12 disposed therein and extending through the bottom edge thereof. The slots 12 are defined by three elongated spaced apart and parallel legs 20 and connected by an elongated horizontal arm 22 across the top of each leg. One common front surface of each leg 20 and a front surface of the arm 22 define the vertical face 14 with the top surface of the arm 22 defining the top face 18. A flat mounting member 24 extends horizontally from the bottom of each leg 20. Holes 25 in each member 24 receive mounting screws 26 to attach the game base 10 to the floor 28 or other given plane. A gusset 30 or center brace attached to the center leg at its rear surface reinforces the game base 10. The gusset 30 also has a mounting member 32 extending from the bottom therefrom and parallel and coplanar with the other mounting members 24. The vertical face 14, top face 18, mounting members 24, 32 and gusset 30 are integral.

Three pegs 16, threaded at one end, are fastened in horizontal alignment to threaded holes in the top face 18 and extend outwardly therefrom. The outer pegs each have a given length and extend perpendicularly from the top face. The center peg is longer than the given length and is disposed at an acute angle with respect to the two outer legs and preferably at 15° therefrom.

The game utilizes at least one game ring 34 having an outer diameter 36 and thickness configured to pass through any of the slots 12 when rolled therethrough and an inner diameter 38 configured to encircle any of the peg 16 when thrown thereover.

While the preferred embodiment of the invention has been described and illustrated, it will be understood that the invention is in no way limited to this embodiment.

What is claimed is:

1. A game apparatus comprising:

a. a game base having a planar first portion, a second planar portion perpendicular to the first planar portion, a plurality of spaced apart parallel vertical elongated arms, one horizontal elongated arm interconnecting said plurality of vertical arms at the top ends thereof, wherein one common face of the arm corresponds to said first planar portion, the top of said horizontal arm corresponds to said second planar portion, means defining a plurality of elongated apertures through said first portion each having an open side, wherein the spaces between the horizontal arms corresponds to said elongated apertures, and a plurality of pegs each connected at one end thereof to said second portion and projecting outwardly therefrom;

b. means for mounting the game base on a given plane to dispose the first portion perpendicular to the given plane with the open side of the apertures adjacent thereto and the second portion parallel thereto and at the top of the game base, wherein said means mounting the game base includes a plurality of planar mounting members each perpendicularly connected to the bottom end of one of said vertical arms and each having an aperture therethrough for effecting the connecting thereof to said given plane, a brace, said brace connected to one of said plurality of vertical arms on the side thereof opposite to said first planar portion and having an aperture at a lower portion thereof for effecting connecting to the given plane; and c. at least one game ring having an outer diameter and thickness configured to pass through any of the apertures and an inside diameter configured to encircle any of the pegs, whereby each ring can be either rolled through the apertures or thrown around the pegs.

2. A game apparatus according to claim 1, wherein said one of said plurality of arms is located in the center of said plurality of arms.

3. A game apparatus according to claim 1, wherein said plurality of pegs are connected to said horizontal arm and disposed along a line, said plurality of pegs having the outermost pegs thereof having a first height and perpendicular to said second portion and one of said plurality of pegs located between said outermost pegs having a height being greater than said first height and disposed at an acute angle with respect to the axis of said outermost pegs.

4. A game apparatus according to claim 3, wherein said acute angle is 15 °.

5. A game apparatus according to claim 3, wherein said plurality of pegs are three in number.

6. A game apparatus according to claim 1, wherein said one end of each peg is threaded and wherein said second planar portion has three threaded apertures therein each for receiving the threaded end of one peg.

7. A game apparatus according to claim 1, wherein said plurality of arms are three in number.

* * * * *